United States Patent [19]

Jackson

[11] 3,941,502

[45] Mar. 2, 1976

[54] SCREW PROPELLER ASSEMBLIES

[76] Inventor: Albert Jackson, 379 Vale Ave., Ferndale, Randburg, Transvaal Province, South Africa

[22] Filed: July 9, 1974

[21] Appl. No.: 486,912

[30] Foreign Application Priority Data

July 10, 1973 South Africa ..... 73/4617

[52] U.S. Cl. ..... 416/83; 416/108

[51] Int. Cl.[2] ..... B63H 3/02

[58] Field of Search ..... 416/79, 83, 98, 110, 116, 416/108

[56] References Cited

UNITED STATES PATENTS

| | | | |
|---|---|---|---|
| 940,753 | 11/1909 | Tower | 416/83 |
| 2,026,917 | 1/1936 | Smith | 416/110 |
| 2,216,164 | 10/1940 | Schairer | 416/116 X |
| 2,256,918 | 9/1941 | Young | 416/43 |
| 3,572,616 | 3/1971 | Ulisnik | 416/98 X |

FOREIGN PATENTS OR APPLICATIONS

| | | | |
|---|---|---|---|
| 1,290,664 | 9/1972 | United Kingdom | 416/116 |

*Primary Examiner*—Everette A. Powell, Jr.
*Attorney, Agent, or Firm*—Cushman, Darby & Cushman

[57] ABSTRACT

A screw propeller assembly comprising a propeller shaft rotatable co-axially with a swash member, a propeller having a hub connected to the propeller shaft by way of a universal joint wherein the hub is mounted to the universal joint indirectly through jointing members, the jointing members and swash plate co-operating to cause the axis of rotation of the hub to move at an incline to the axis of rotation of the propeller shaft thereby providing a paddle action to the propeller in addition to the rotary motion thereof.

9 Claims, 3 Drawing Figures

Fig 1.
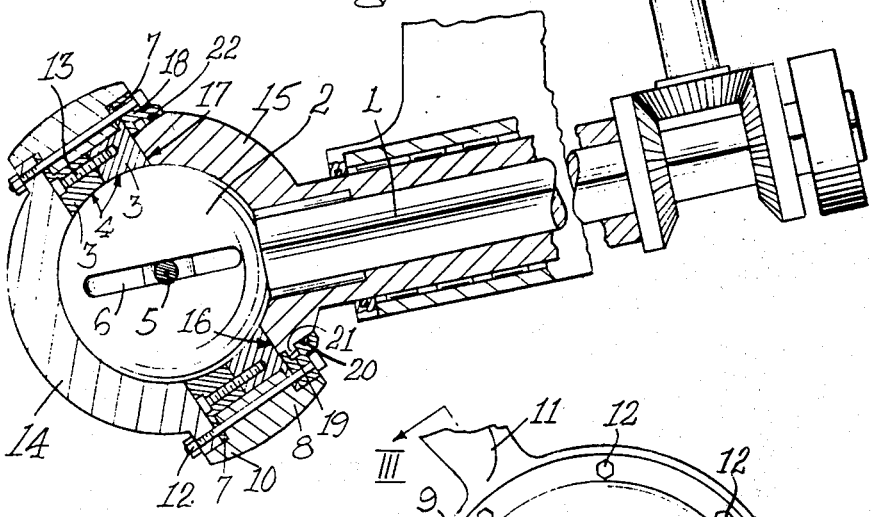
Fig 2.
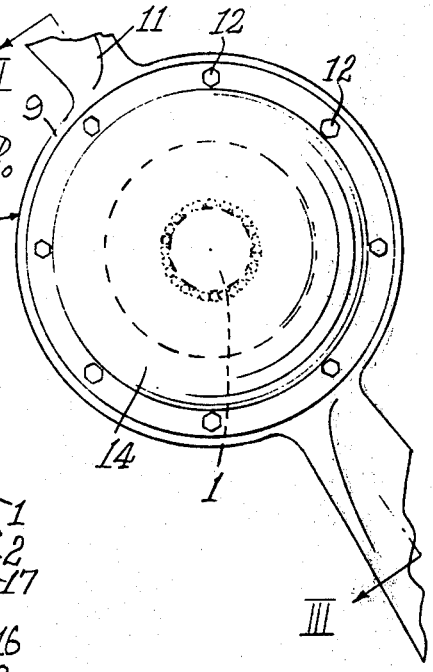
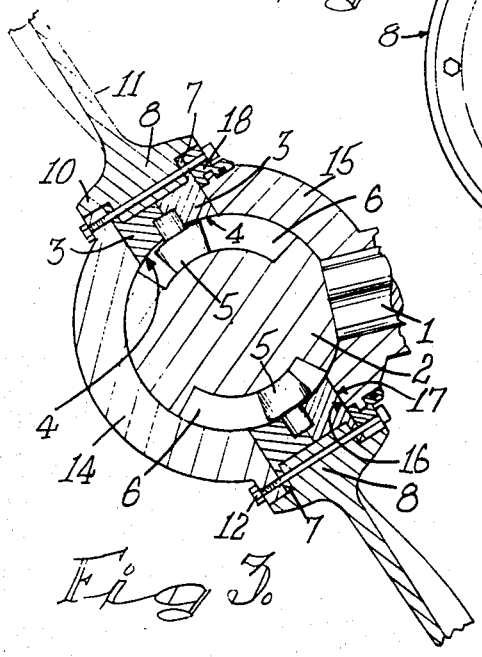
Fig 3.

SCREW PROPELLER ASSEMBLIES

THIS INVENTION relates to screw propeller assemblies and more particularly but not exclusively to such assemblies for use in marine propulsion.

In my British Pat. No. 1,290,664 I disclosed a screw propeller assembly in which a normal propeller action is combined with a paddling action to achieve a higher thrust efficiency than is achieved with conventional screw propellers. The assembly consists essentially of a hub having a set of blades and forming part of a universal joint driven by a propeller shaft and means capable of rocking the hub through a predetermined angle to cause the axis of rotation of the propeller hub to describe a conical locus.

The hub proposed in my said British Patent, forming part of the universal joint is expensive to manufacture and has been found to give rise to an undue amount of vibration in use.

It is an object of this invention to provide an assembly of the above kind in which the above disadvantages are at least reduced.

According to this invention there is provided a screw propeller assembly comprising a propeller shaft having associated therewith a universal joint, a blade hub adapted to be driven by the propeller shaft through the universal joint and means for moving the axis of rotation of the blade hub at an incline to the axis of rotation of the propeller shaft to provide a paddle action of the blades, the invention being characterized in that the blade hub is independant of, and indirectly connected to the universal joint through suitable jointing members which may themselves form part of the universal joint.

Further features of the invention provide for the universal joint to be formed by a ball and a pair of jointing members having part-spherical surfaces shaped to partially embrace the ball wherein lugs are located to transmit rotary motion from the ball to the jointing members, the latter being adapted to support the balde hub for the jointing members and blade hub to be clamped together releasably by means of bolts, for the blade hub to be a ring having a terminal transverse flange carrying a set of blades and for the said means to be a swash member mounted for rotation about the propeller shaft and having a bearing surface inclined to the axis of the propeller shaft.

Still further features of the invention provide for the lugs to be pivotally supported by the jointing members and to extend into keyways cut in the ball in a plane including the axis of the propeller shaft, for the jointing members to abut each other and a diameter of the ball and for a split ring to hold the hub and jointing members relative to the swash member, the split ring further providing a housing for a ring seal action between the ring and swash member.

Preferably, the universal joint comprises a ball secured to an end of a propeller shaft to rotate in unison therewith. The jointing members abut along a diameter of the ball and provide an inner part spherical surface co-operating with the ball, and rotatable lugs carried by the jointing members extend into grooves in the ball which extend in a plane including the axis of the propeller shaft. Thus the jointing members and consequently the hub carried thereby rotate in unison with the propeller shaft.

The swash member may have a swash-surface in the form of an annular end face surrounding a part spherical recess in the swash member which receives part of the ball. The swash-member further may define an end of a hollow drive shaft within which the propeller shaft is rotatably mounted and two shafts are preferably arranged to be rotated in opposite directions.

The above and other features of the invention will become apparent from the following description of a preferred embodiment of the invention. In this description, reference will be made to the accompanying drawings in which:

FIG. 1 is a longitudinal sectional elevation of a screw propeller assembly;

FIG. 2 is a rear elevation of the assembly, and

FIG. 3 is a sectional elevation taken along line III of FIG. 2.

In this embodiment of the invention the screw propeller assembly is one suited for marine propulstion but it is considered that it might be adapted for use in certain types of aircraft as well.

The assembly comprises a propeller shaft 1 and a ball joint formed by a ball 2 fast on the shaft 1 and a pair of jointing members 3. The latter have part-spherical surfaces 4 adapted to particularly embrace the ball, the arrangement preferably being one in which the surfaces 4 encompass a relatively small area of the ball. It will be understood that the jointing members abut in this case abut along a diameter of the ball. However, this could be shaped to abut transversely in other embodiments of the invention. Motion is transmitted from the ball to the jointing members through a pair of lugs 5 projecting inwardly from the part-spherical surfaces 4 of the jointing members and seating in grooves of keyways 6 extending partway around the circumference of the ball in a plane through the center thereof and including the axis of the propeller shaft 1. In this case there are provided two such keyways and lugs diametrically opposed to each other. The lugs are rotatably mounted in the jointing members and have enlarged plate-like formations extending into the keyways to provide for better wearing of the lugs.

The jointing members 3 having flanges 7 on their outer surfaces and spaced apart for retaining a blade hub 8 between them. The blade hub is preferably formed as a ring 9 with a terminal transverse flange 10 carrying the blades 11, which are in this case integral with the hub. The ball joint described above is thus independent of the hub 8, motion being transmitted from the jointing members 3 to the hub 8 through a plurality of bolts 12 releasably clamping these parts together. The jointing members are preferably secured together independently as well by means of bolts 13. The assembly includes an end cap 14 forming the nose of the assembly the end cap being secured to the jointing members and hub by means of the bolts 12 which secure the hub to the jointing members. The end cap is basically part spherical in shape so as to receive the protruding portion of the ball therein.

Means for moving the axis of rotation of the hub and jointing members assembly at an incline to the axis of the propeller shaft, is provided in the form of a swash member 15 mounted for rotation about the propeller shaft. The swash member has a planar annular bearing or swash surface 16 inclined to the axis of the propeller shaft, the surface 16 being arranged to bear against the nearer jointing member 3 so that rotation of the swash member relative to the propeller shaft will cause the desired paddle action of the assembly.

A suitable roller or ball bearing may be embodied in the assembly to reduce friction between the bearing surface 16 and the hub and jointing member assembly. However, it is preferred that the surface 16 simply abuts a side surface 17 of the adjacent jointing member. A locating ring 18 split diametrically to enable it to be installed, is bolted to the jointing members by means of the bolts 12 securing the latter together the locating ring being positioned against the outer portion of the said adjacent side surface 17 of the jointing member nearer the swash or bearing surface. The inner surface of the locating ring is provided with two circumferentially extending grooves 19, 20 therein, the groove 19 nearer the bearing surface receiving a locating flange 21 integral with the swash member and the other 20 housing a sealing ring 22 co-operating with a cylindrical portion of the outer surface of the swash member.

In use, the propeller shaft 1 is driven in one direction to rotate the blade hub through the ball joint described above. In this way the normal propeller action will result but with the axis of rotation inclined to the propeller shaft axis when the swash member is stationary. At the same time the swash member is driven in the opposite direction to the shaft 1 to cause the said axis of rotation of the hub to describe a conical locus. Thus there is superimposed on the normal propeller action a paddling action and this has been found to give a propeller action of greater efficiency than conventional propeller action.

The blades 11 will be designed to present a maximum surface area to the water upon rearward motion of the blades and a minimum area of resistance upon forward motion thereof for the paddling motion. Any suitable gearing arrangement may be used to drive the propeller shaft and swash member and the latter will preferably be geared to enable it to be rotated at different speeds relative to the propeller shaft. The optimum speed of rotation of the swash member relative to that of the propeller will depend on the blade design and the angle of inclination of the swash or bearing surface relative to the axis of the propeller shaft.

In a simple arrangement illustrated the hollow shaft and propeller shaft are fitted with bevel gears driven by a single bevel gear located between them.

The separate parts of the assembly described above are relatively easy to manufacture and the assembly has been found to give rise to lesser vibration than is the case with the previous assembly described above.

The invention is not limited to the embodiment described above and may be carried out in different ways without departing from the scope of the invention. For instance, the ball joint described above may be replaced by a suitably modified Hooke's joint. Also means may be provided for adjusting the inclination of the bearing surface of the swash member and the latter may be replaced by any suitable device capable of producing the desired rocking motion of the blade hub. The invention may also be applied to screw propellers in fans, helicopters air conditioners, pumps, or other apparatus employing screw propellers.

I claim:

1. A screw propeller assembly comprising a propeller shaft having associated therewith a universal joint defined by a ball rotatable in unison with the propeller shaft, a pair of jointing members connected together with one of these jointing members being located on each side of a diametrical plane through the ball and having internal surfaces shaped for co-operation with the ball, and at least one lug for transmitting rotation of the ball to the jointing members, a blade hub carried by the jointing members and a swash member co-operating with the jointing members to hold the axis of rotation of the hub at an incline to the axis of rotation of the propeller shaft, means for rotating the swash member in a direction opposite that of the propeller to cause said axis of rotation of the hub to describe a conical locus and thereby impart a paddle action to the blades.

2. A screw propeller assembly as claimed in claim 1 in which the pair of jointing members are connected to the ball by a plurality of lugs extending from the jointing members into grooves provided in the surface of the ball to transmit rotary motion from the latter to the jointing members.

3. A screw propeller assembly as claimed in claim 1 in which the jointing members are bolted together to abut each other on a diameter of the ball.

4. A screw propeller assembly as claimed in claim 1 in which the blade hub is in the form of a ring having blades extending therefrom, said ring having an inner portion located between outwardly extending flanges on the jointing members.

5. A screw propeller assembly as claimed in claim 4 in which the hub is secured to the jointing members by means of bolts and said hub is provided with an outer transverse flange carrying the blades.

6. A screw propeller assembly as claimed in claim 1 in which the swash member is mounted for rotation about the propeller shaft and has a bearing surface inclined to the axis of rotation of the propeller shaft.

7. A screw propeller assembly as claimed in claim 6 in which the swash member is carried on a rotatable tube through which the propeller shaft extends.

8. A screw propeller assembly as claimed in claim 6 in which a diametrically split ring holds the hub and jointing members relative to the swash member by means of an outwardly directed co-operating tongue and groove arrangement.

9. A screw propeller assembly as claimed in claim 8 in which the split ring provides a housing in the form of a groove for a ring seal acting between the split ring and swash member.

* * * * *